US008267748B2

(12) United States Patent
Lee

(10) Patent No.: US 8,267,748 B2
(45) Date of Patent: Sep. 18, 2012

(54) SAFE GUARDING ASSEMBLY FOR A GRINDING GUN

(76) Inventor: Ryh Hsiung Lee, Hsinchu Hsien (TW)

( * ) Notice: Subject to any disclaimer, the term of this patent is extended or adjusted under 35 U.S.C. 154(b) by 1036 days.

(21) Appl. No.: 12/212,473

(22) Filed: Sep. 17, 2008

(65) Prior Publication Data

US 2010/0068980 A1 Mar. 18, 2010

(51) Int. Cl.
*B24B 55/00* (2006.01)

(52) U.S. Cl. ..... 451/344; 451/358; 451/359; 451/454

(58) Field of Classification Search ..... 30/166.3, 30/388, 390; 451/344, 345, 346, 349, 354, 451/355, 356, 357, 358, 359, 451, 454
See application file for complete search history.

(56) References Cited

U.S. PATENT DOCUMENTS 4,137,589 A * 2/1979 Sukhraj ..... 15/28
4,197,061 A * 4/1980 Hill ..... 418/173
4,866,319 A * 9/1989 Crutchfield ..... 310/47
5,259,914 A * 11/1993 Fisher ..... 156/763
5,775,981 A * 7/1998 Yang ..... 451/295
5,941,764 A * 8/1999 Yang ..... 451/358
5,988,957 A * 11/1999 Wheeler ..... 408/239 R
6,343,901 B2 * 2/2002 Wheeler et al. ..... 408/239 R
6,389,701 B1 * 5/2002 Friedland ..... 30/391
6,561,063 B1 * 5/2003 Mulford et al. ..... 82/128

* cited by examiner

*Primary Examiner* — Timothy V Eley
(74) *Attorney, Agent, or Firm* — C. G. Mersereau; Nikolai & Mersereau, P.A.

(57) ABSTRACT

A safe guarding assembly for a grinding gun has a body, a rear protective cap and a front protective cap. The body has a casing. The casing has a front end, a shaft hole and a retaining ring. The shaft hole is formed through the casing. The retaining ring is formed on and protrudes from the front end of the casing around the shaft hole. The rear protective cap is mounted securely around the retaining ring of the casing and has a front end, an inner thread, a through hole and a mounting ring. The mounting ring is formed on and protrudes from the front end of the rear protective cap and has an external surface and an outer thread. The front protective cap is mounted detachably around the mounting ring of the rear protective cap and has an inner thread and a conical segment.

8 Claims, 9 Drawing Sheets

SAFE GUARDING ASSEMBLY FOR A GRINDING GUN

BACKGROUND OF THE INVENTION

1. Field of the Invention

The present invention relates to a safe guarding assembly, and more particularly relates to a safe guarding assembly for a grinding gun that can be used safely.

2. Description of Related Art

With reference to FIGS. 7 and 8, a conventional grinding gun is used to grind and polish surfaces of wood or metal and has a casing (50), a drive shaft (52), a transmitting shaft (51), a clutch shaft (53), a spring (54), a cover (55), a clamping tube (56) and a protective cap (57).

The casing (50) is hollow and has an external surface, a front end and a rear end.

The drive shaft (52) is rotatably mounted in the casing (50) and has a rear end and a front end. The rear end of the drive shaft (52) extends out of the rear end of the casing (50) and is connected to a motor.

The transmitting shaft (51) is rotatably mounted in the casing (50) and has a rear end, a front end, a diameter, a mounting rod (512) and a threaded pipe (511). The mounting rod (512) is axially formed on and protrudes from the front end of the transmitting shaft (51) and extends out of the front end of the casing (50) and has a diameter smaller than that of the transmitting shaft (51) and a front end. The threaded pipe (511) is formed on and protrudes from the front end of the mounting rod (512) and has an inner thread and a diameter smaller than that of the mounting rod (512).

The clutch shaft (53) is rotatably mounted on the external surface of the casing (50) to control the transmitting shaft (51) connecting to or separating form the drive shaft (52).

The spring (54) is mounted around the threaded pipe (511) of the drive shaft (51) and has a front end.

The cover (55) is mounted around the mounting rod (512) and the threaded pipe (511) of the transmitting shaft (51) and has an inner surface, a front end, a rear end, a conical hole (551) and a flange (552). The inner surface of the cover (55) presses against the front end of the spring (54). The conical hole (551) is formed through the front end of the cover (55) and aligns with the threaded pipe (511) of the transmitting shaft (51). The flange (552) is formed annularly on and protrudes from the rear end of the cover (55).

The clamping tube (56) is mounted securely in the transmitting shaft (51) and has an inner end, an outer end and a collet (561). The inner end of the clamping tube (56) is mounted securely in the threaded pipe (511) of the transmitting shaft (51). The outer end of the clamping tube (56) extends out of the conical hole (551) of the cover (55). The collet (561) is formed on the outer end of the clamping tube (56) and presses against the cover (55) in the conical hole (551) to hold a grinding element (A) in the clamping tube (56).

The protective cap (57) is mounted securely around the front end of the casing (50) to surround the rear end of the cover (55) and has a front end, a rear end and a through hole (571). The rear end of the protective cap (57) is mounted securely around the front end of the casing (50). The through hole (571) is formed through the front end of the protective cap (57) and is mounted around the cover (55) near the flange (552).

With further reference to FIGS. 7 to 9, when a user wants to draw the grinding element (A) out of the clamping tube (56), the clutch shaft (53) is rotated to make the transmitting shaft (51) move forward relative to the cover (50) and separate from the drive shaft (52). When the transmitting shaft (51) moves relative to the cover (55), the collet (561) of the clamping tube (56) will move forward relative to the conical hole (551) of the cover (55). Then, the user can draw the grinding element (A) out of the clamping tube (56) easily.

However, when the grinding element (A) draws out of the clamping tube (56), the cover (55) will move forward relative to the transmitting shaft (51) and the protective cap (57) by the spring (54) to cause the flange (552) of the cover (55) to press against the front end of the protective cap (57). When the cover (55) presses against the protective cap (57) and the transmitting shaft (51) is connected to and is rotated by the drive shaft (52) at the same time, the cover (55) and transmitting shaft (51) will get stuck with the protective cap (57) and this will cause the transmitting shaft (51) to wear.

In addition, when a user uses the conventional grinding gun to grind and polish surfaces of wood or metal, the cover (55) engages the collet (561) of the clamping tube (56) and is rotated with the transmitting shaft (51) at a high speed and this will injure the user if the user touches the rotating cover (55).

To overcome the shortcomings, the present invention provides a safe guarding assembly for a grinding gun to mitigate or obviate the aforementioned problems.

SUMMARY OF THE INVENTION

The main objective of the present invention is to provide a safe guarding assembly for a grinding gun that can be used safely.

The safe guarding assembly in accordance with the present invention for a grinding gun has a body, a rear protective cap and a front protective cap. The body has a casing. The casing has a front end, a shaft hole and a retaining ring. The shaft hole is formed through the casing. The retaining ring is formed on and protrudes from the front end of the casing around the shaft hole. The rear protective cap is mounted securely around the retaining ring of the casing and has a front end, an inner thread, a through hole and a mounting ring. The mounting ring is formed on and protrudes from the front end of the rear protective cap and has an external surface and an outer thread. The front protective cap is mounted detachable around the mounting ring of the rear protective cap and has an inner thread and a conical segment.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
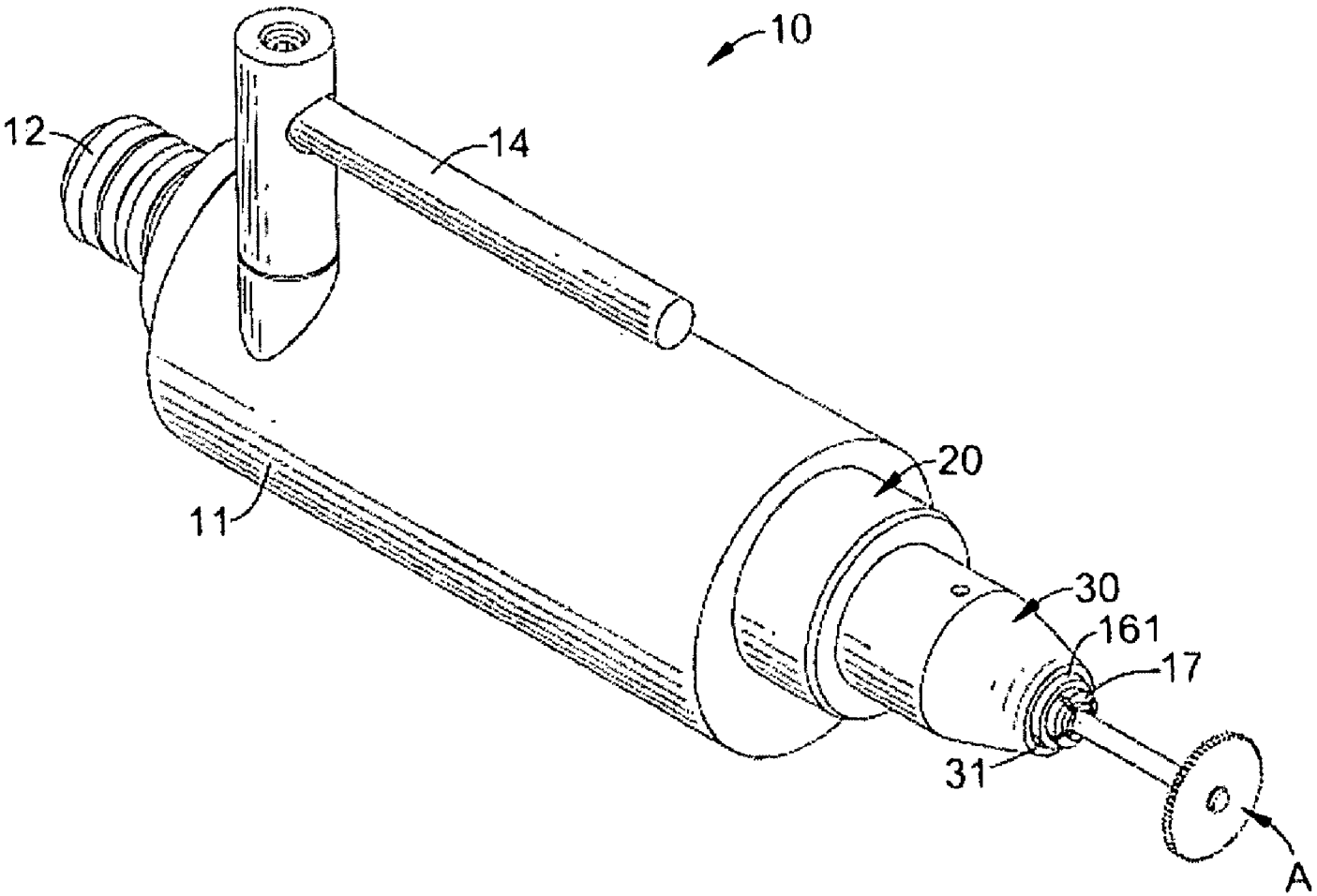
FIG. 1 is a perspective view of a safe guarding assembly in accordance with the present invention for a grinding gun.
Figure 2:
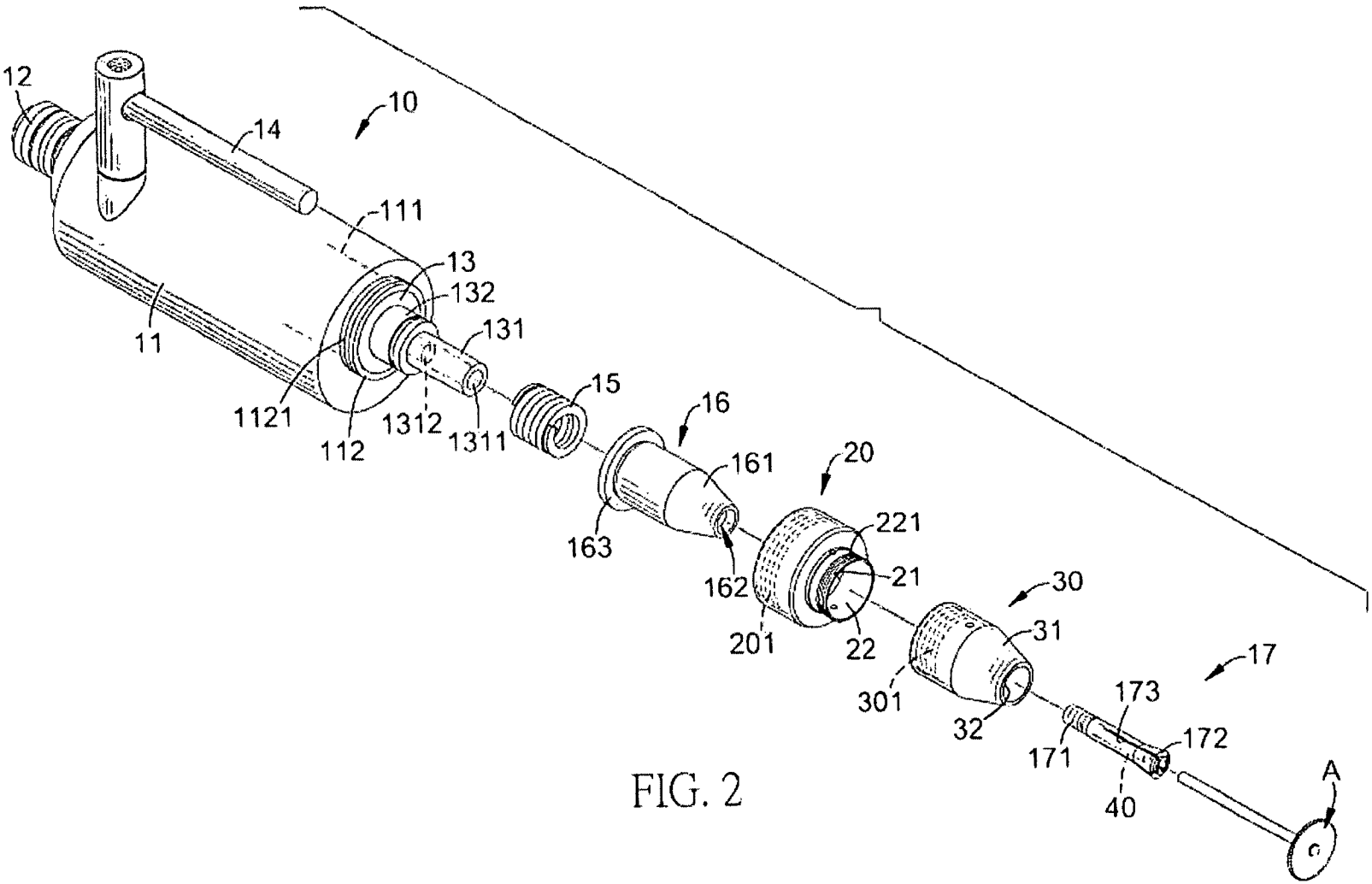
FIG. 2 is an exploded perspective view of the safe guarding assembly in FIG. 1.
Figure 3:
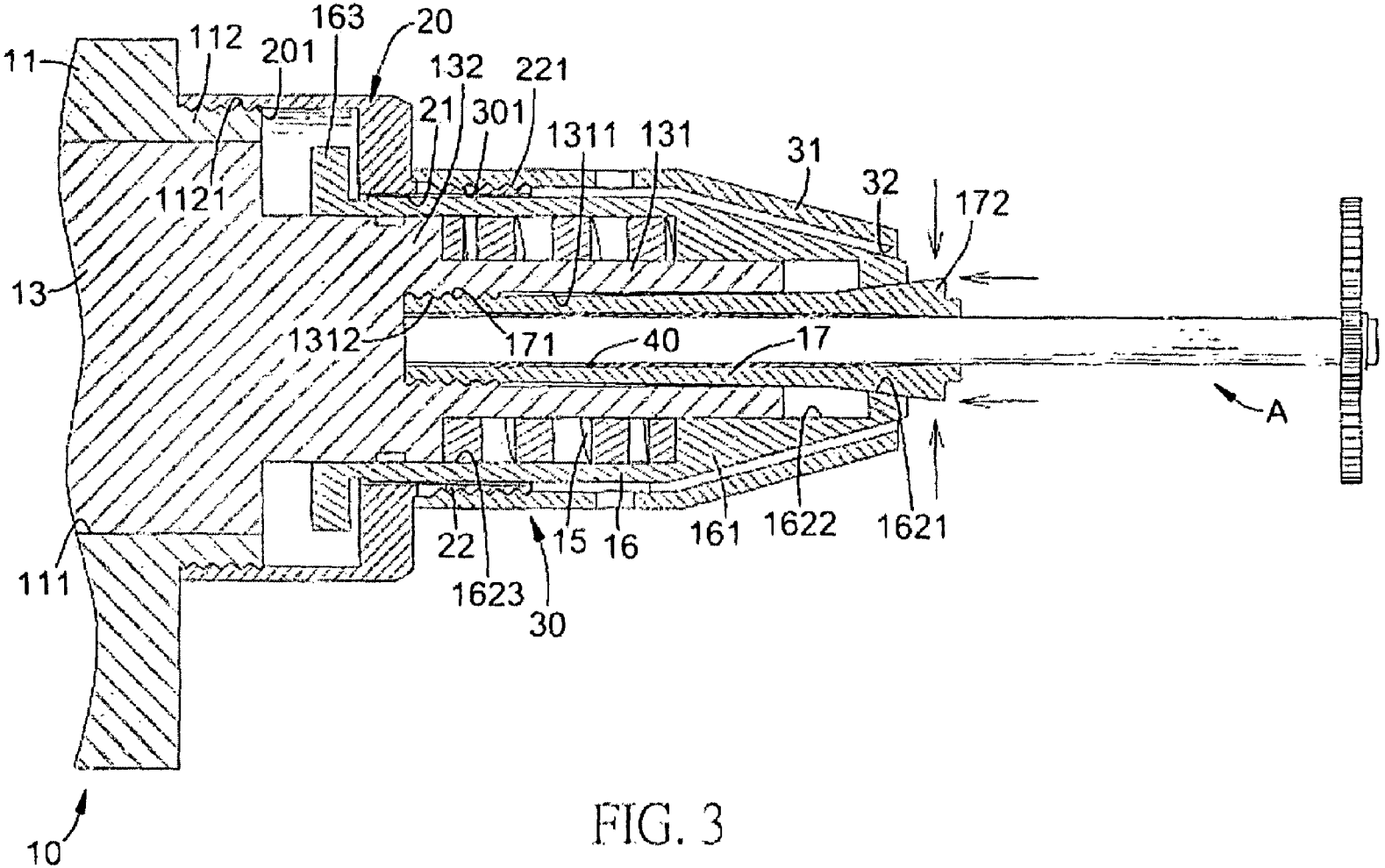
FIG. 3 is an enlarged side view in partial section of the safe guarding assembly in FIG. 1.

With reference to FIGS. 1 to 3, a safe guarding assembly in accordance with the present invention for a grinding gun comprises a body (10), a rear protective cap (20), a front protective cap (30) and an optional supporting tube (40).

The body (10) has a casing (11), a drive shaft (12), a transmitting shaft (13), a clutch shaft (14), a spring (15), a cover (16) and a clamping tube (17).

The casing (11) is hollow and has an external surface, a front end, a rear end, a shaft hole (111) and a retaining ring (112). The shaft hole (111) may be eccentrically formed through the from end and the rear end of the casing (11). The retaining ring (112) is formed on and protrudes from the front end of the casing (11) around the shaft hole (111) and has an external surface and an outer thread (1121). The outer thread (1121) is formed around the external surface of the retaining ring (112).

The drive shaft (12) is rotatably mounted in the rear end of the casing (11) and has a rear end and a front end. The rear end of the drive shaft (12) extends out of the rear end of the casing (11) and is connected to a motor.

The transmitting shaft (13) is rotatably mounted in the front end of the casing (11) and has a rear end, a front end, a diameter, a mounting rod (132) and a threaded pipe (131). The mounting rod (132) is axially formed on and protrudes from the front end of the transmitting shaft (13), extends out of the retaining ring (112) of the casing (11) and has a diameter smaller than that of the transmitting shaft (13) and a front end. The threaded pipe (131) is formed on and protrudes from the front end of the mounting rod (132) and has a diameter smaller than that of the mounting rod (132), a rear end, a holding hole (1311) and an inner thread (1312). The holding hole (1311) is axially formed in the threaded pipe (131). The inner thread (1312) is formed in the holding hole (1311) near the rear end of the threaded pipe (131).

The clutch shaft (14) is rotatably mounted on the external surface of the casing (11) to control the transmitting shaft (13) connecting to or separating form the drive shaft (12).

The spring (15) is mounted around the threaded pipe (131) of the drive shaft (13) and has a front end.

The cover (16) is mounted around the mounting rod (132) and the threaded pipe (131) of the transmitting shaft (13) and has a front end, a rear end, a pointed nose (161), a mounting segment (162) and a flange (163). The pointed nose (161) is formed on and protrudes from the front end of the cover (16) and has a free end. The mounting segment (162) is formed through the cover (16) and the pointed nose (161) and has a conical hole (1621), a mounting hole (1623) and a mounting recess (1622). The conical hole (1621) is formed through the free end of the pointed nose (161) and aligns with the threaded pipe (131) of the transmitting shaft (13). The mounting hole (1623) is formed through the rear end of the cover (16) to hold the spring (15) around the threaded pipe (131) inside and the front end of the spring (15) presses against the cover (16) in the mounting hole (1623). The mounting recess (1622) is defined in the pointed nose (161) and communicates with the conical hole (1621) and the mounting hole (1623). The flange (163) is formed annularly on and protrudes from the rear end of the cover (16).

The clamping tube (17) is mounted securely in the holding hole (1311) of the threaded pipe (131) and has an external surface, an inner end, an outer end, an outer thread (171) and a collet (172). The inner end of the clamping tube (17) is mounted securely in the holding hole (1311) of the threaded pipe (131) of the transmitting shaft (13). The outer thread (171) is formed around the external surface of the clamping tube (17) near the inner end and is screwed with the inner thread (1312) of the threaded pipe (131). The outer end of the clamping tube (17) extends out of the conical hole (1621) of the cover (16). The collet (172) is formed on the outer end of the clamping tube (17) and presses against the cover (16) in the conical hole (1621) to hold a grinding element (A) with the clamping tube (17) and has an external surface and multiple slits (173). The slits (173) are individually formed through the external surface of the collet (172) at intervals.

The rear protective cap (20) is circular, is mounted securely around the front end of the casing (11) to surround the rear end of the cover (16) and has a rear end, a front end, an internal surface, an inner thread (201), a through hole (21) and a mounting ring (22). The rear end of the rear protective cap (20) is mounted around the retaining ring (112) of the casing (11). The inner thread (201) is formed around the internal surface of the rear protective cap (20) near the rear end and is screwed with the outer thread (1121) of the retaining ring (112). The front end of the rear protective cap (20) has a clearance relative to the flange (163) of the cover (16). The through hole (21) is formed through the front end of the rear protective cap (20) to surround the cover (16) near the flange (163). The mounting ring (22) is formed on and protrudes from the front end of the rear protective cap (20) and has an external surface and an outer thread (221). The outer thread (221) is formed around the external surface of the mounting ring (22).

The front protective cap (30) is mounted detachably around the rear protective cap (20) to surround the front end of the cover (16) and has a shape corresponding to the cover (16), a rear end, a front end, an internal surface, an inner thread (301) and a conical segment (31). The rear end of the front protective cap (30) is mounted around the mounting ring (22) of the rear protective cap (20). The inner thread (301) is formed around the internal surface of the front protective cap (30) near the rear end and is screwed with the outer thread (221) of the mounting ring (22). The conical segment (31) is formed on and protrudes from the front end of the front protective cap (30) to surround the pointed nose (161) of the cover (16) and has a free end and a tube hole (32). The tube hole (32) is formed through the free end of the conical segment (31) and is mounted around the conical hole (1621) of the pointed nose (161).

The supporting tube (40) is mounted securely in the clamping tube (17) and has a front end. The front end of the supporting tube (40) presses against the collet (172) of the clamping tube (17) to make the collet (172) pressing against the conical hole (1621) of the cover (16).

With reference to FIGS. 1 and 3, when a user inserts a grinding element (A) into the supporting tube (40) to grind and polish surfaces of wood or metal, the clutch shaft (14) is rotated to make the transmitting shaft (13) moving backward and connecting to the drive shaft (12). Consequently, the collet (172) of the clamping tube (17) will clamp an external surface of the grinding element (A) by pressing against the conical hole (1621) of the cover (16) when the transmitting shaft (13) moves backward relative to the front protective cap (20). The protective caps (20, 30) are respectively mounted around the mounting rod (132) and the threaded pipe (131) of the transmitting shaft (13) and the cover (16), and this can prevent the user from touching the rotating cover (16) and transmitting shaft (13) at high speed.

Figure 4:
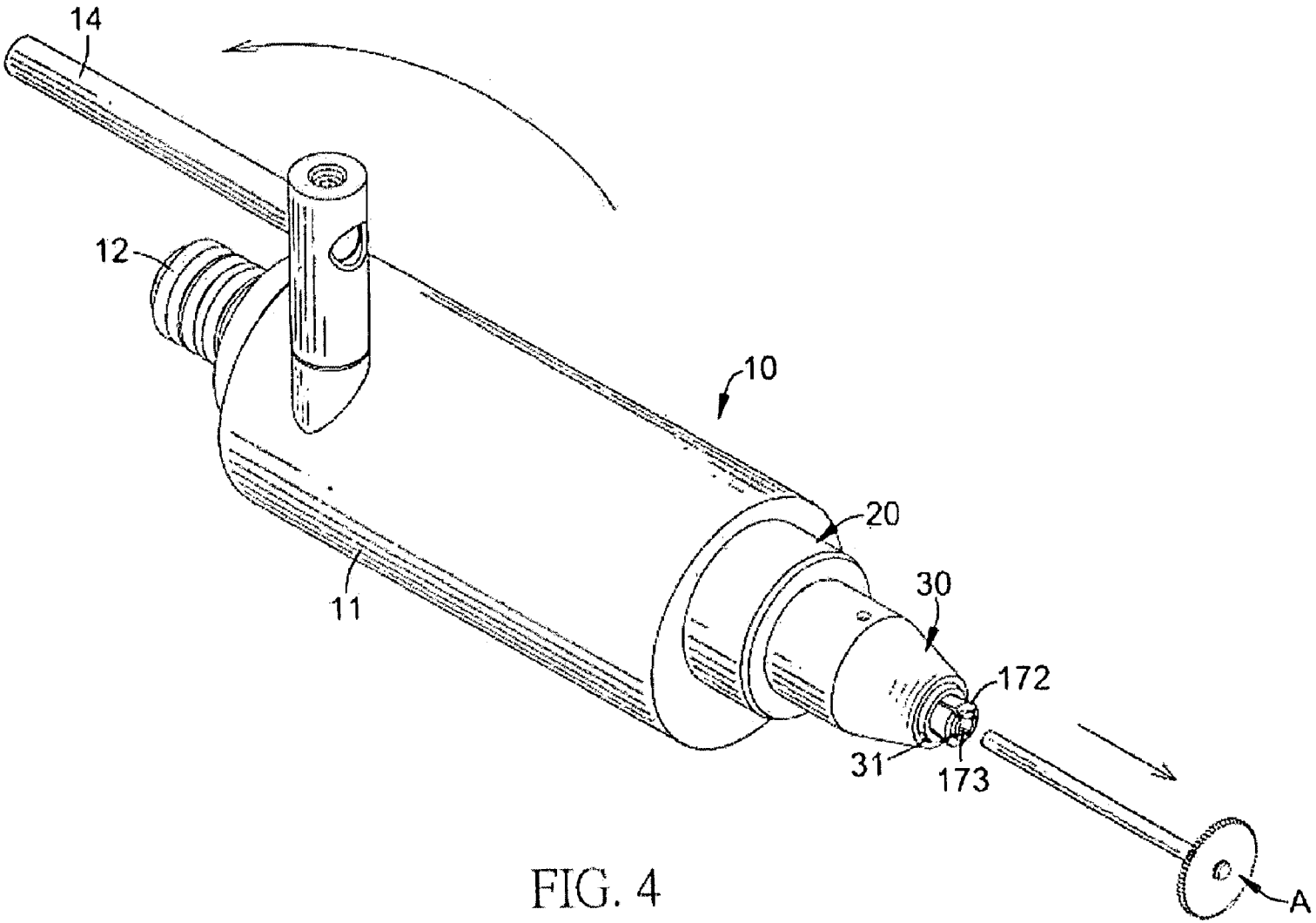
FIG. 4 is an operational perspective view of the safe guarding assembly in FIG. 1.
Figure 5:
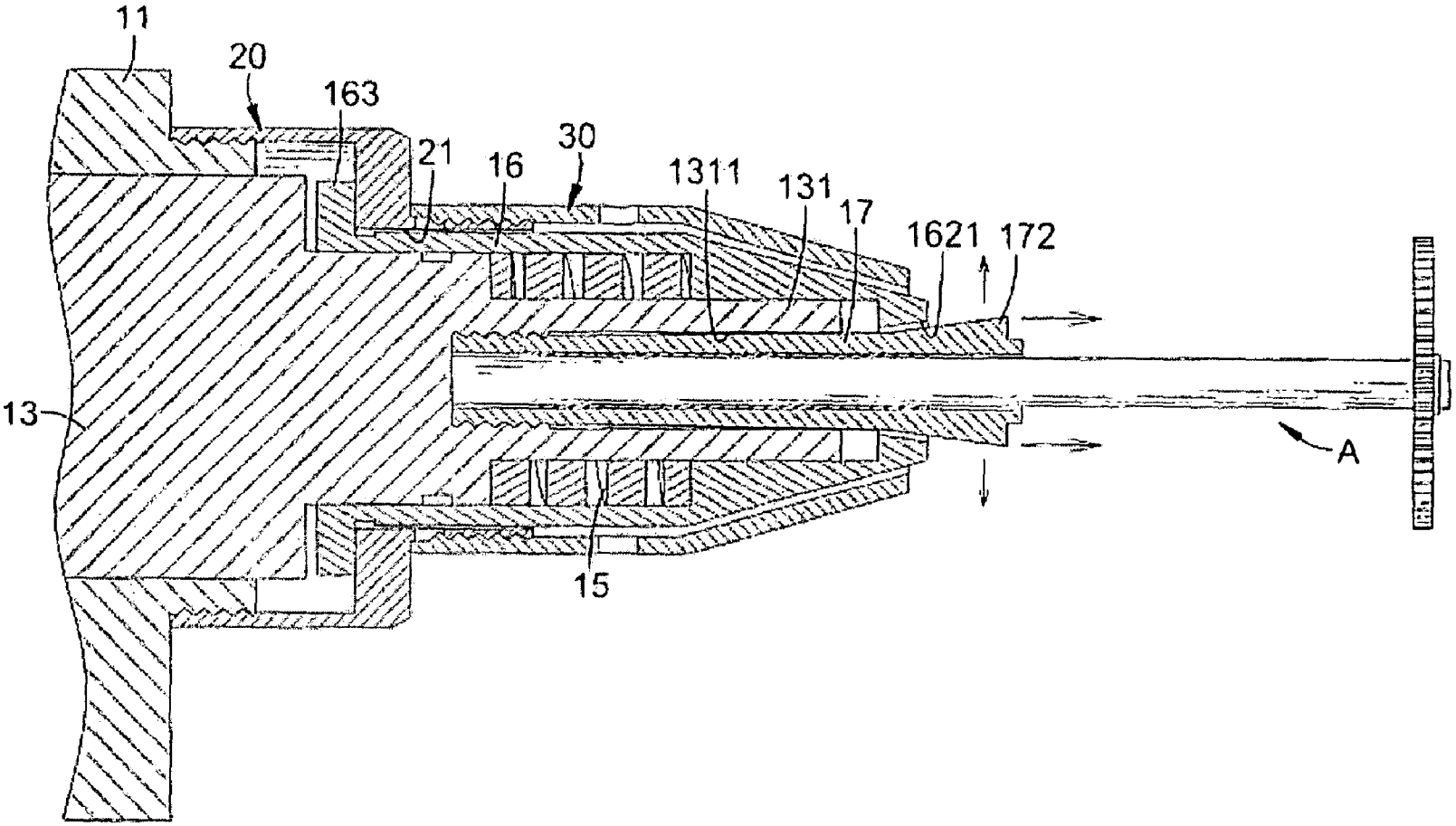
FIGS. 5 and 6 are enlarged operational side views in partial section of the safe guarding assembly in FIG. 1.

With reference to FIGS. 4 and 5, when the user wants to separate the grinding element (A) from the supporting tube (40), the clutch shaft (14) is rotated relative to the casing (10) to make the transmitting shaft (13) move forward relative to the cover (16) and separate from the drive shaft (12). When the transmitting shaft (13) moves forward relative to the cover (16), the collet (172) of the clamping tube (17) will separate from the conical hole (1621) and the user can pull the grinding element (A) out of the supporting tube and the clamping tube (17) easily.

Figure 6:
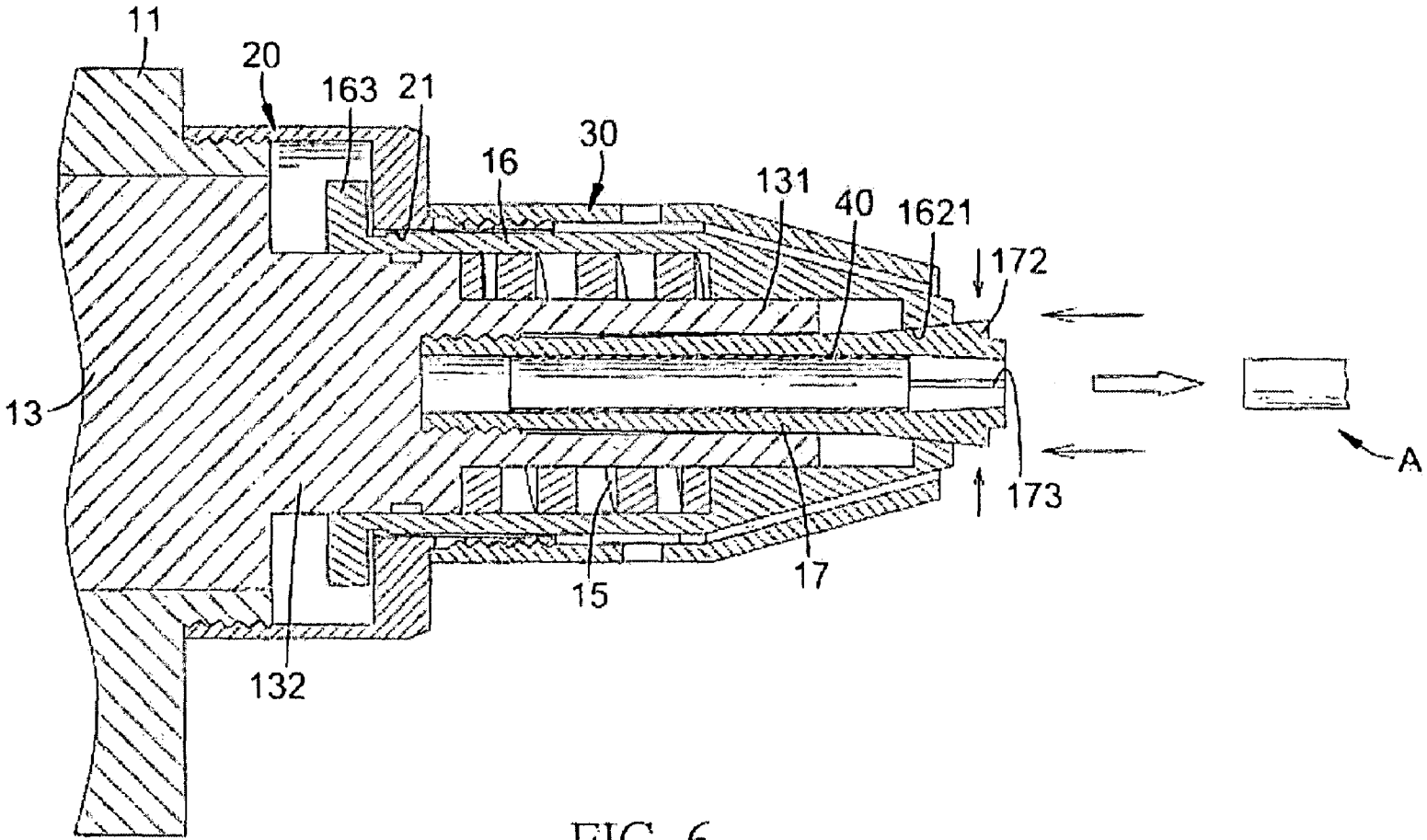
Figure 7:
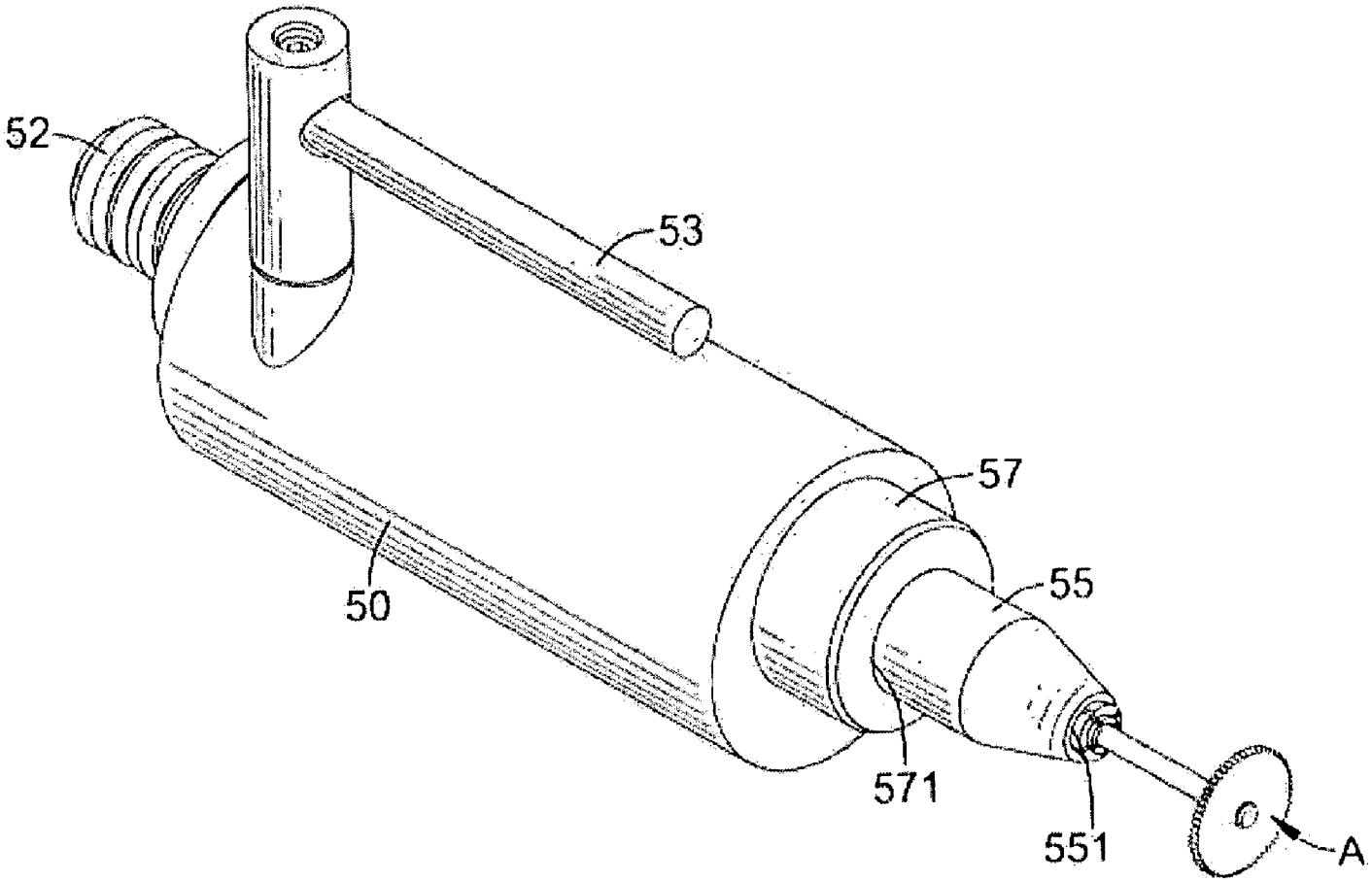
FIG. 7 PRIOR ART
FIG. 7 is a perspective view of a conventional grinding gun in accordance with the prior art.
Figure 8:
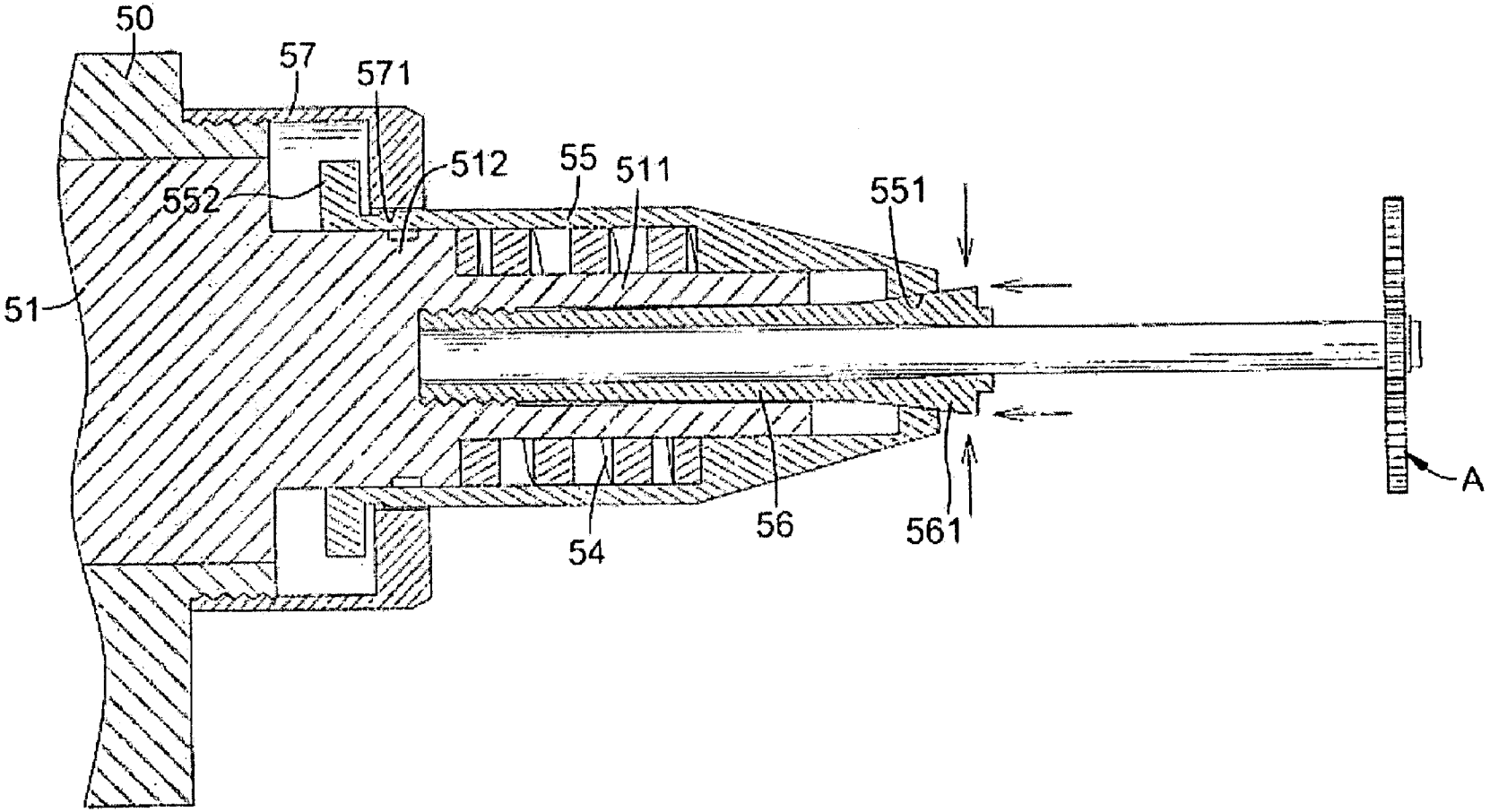
FIG. 8 PRIOR ART
FIG. 8 is an enlarged side view in partial section of the conventional grinding gun in FIG. 7.
Figure 9:
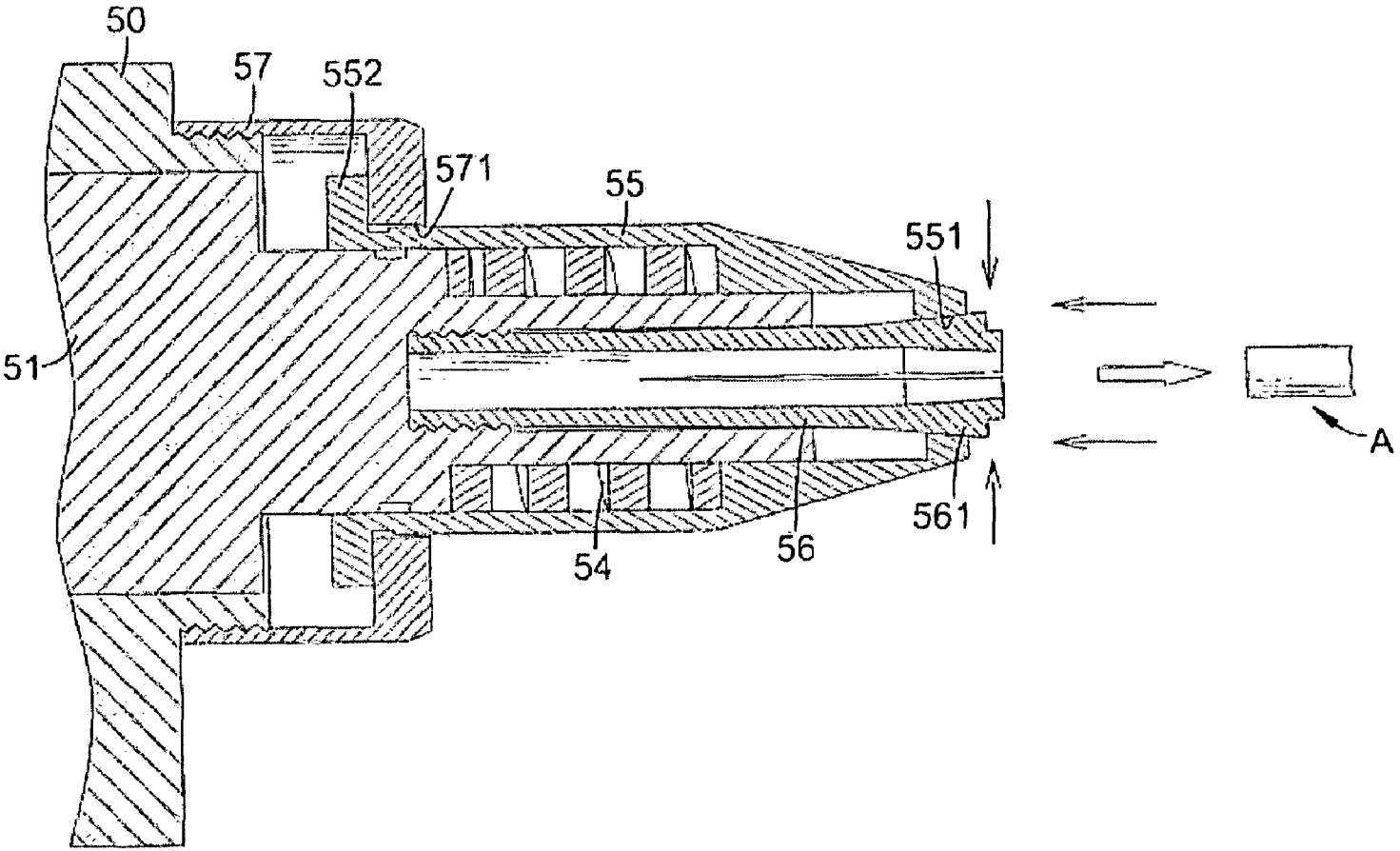
FIG. 9 PRIOR ART
FIG. 9 is an enlarged operational side view in partial section of the conventional grinding gun in FIG. 7.

With reference to FIG. 6, when the grinding element (A) is separated from the supporting tube (40), the front end of the supporting tube (40) is pressed against the collet (172) of the clamping tube (17) to make the collet (172) pressing against the conical hole (1621) of the cover (16). When the user rotates the clutch shaft (14) to make the transmitting shaft (13) move back to the original position and connecting to the drive shaft (12), the cover (16) will move backward relative to the protective caps (20, 30) by the collet (172) engaging the conical hole (1621) of the cover (16). Then, there is a clearance between the rear protective cap (20) and the flange (163) of the cover (16). The clearance between the flange (163) and the front end of the rear protective cap (20) can prevent the cover (16) and the transmitting shaft (13) from getting stuck with the rear protective cap (20) when the cover (16) and the transmitting shaft (13) are rotated by the drive shaft (12).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A safe guarding assembly for a grinding gun having
- a body having
  - a casing being hollow and having
    - an external surface;
    - a front end;
    - a rear end;
    - a shaft hole being formed through the front end and the rear end of the casing; and
    - a retaining ring being formed on and protruding from the front end of the casing around the shaft hole and having
      - an external surface; and
      - an outer thread being formed around the external surface of the retaining ring;
  - a rear protective cap being circular, being mounted securely around the front end of the casing and having
    - a rear end being mounted around the retaining ring of the casing;
    - a front end;
    - an internal surface;
    - an inner thread being formed around the internal surface of the rear protective cap near the rear end and being screwed with the outer thread of the retaining ring;
    - a through hole being formed through the front end of the rear protective cap; and
    - a mounting ring being formed on and protruding from the front end of the rear protective cap and having
      - an external surface; and
      - an outer thread being formed around the external surface of the mounting ring; and
  - a front protective cap being mounted detachably around the rear protective cap and having
    - a rear end being mounted around the mounting ring of the rear protective cap;
    - a front end;
    - an internal surface;
    - an inner thread being formed around the internal surface of the front protective cap near the rear end and being screwed with the outer thread of the mounting ring; and
    - a conical segment being formed on and protruding from the front end of the front protective cap and having
      - a free end; and
      - a tube hole being formed through the free end of the conical segment.

2. The safe guarding assembly as claimed in claim 1, wherein the body further has
- a drive shaft being rotatably mounted in the rear end of the casing and having
  - a rear end extending out of the rear end of the casing; and
  - a front end;
- a transmitting shaft being rotatably mounted in the front end of the casing and having
  - a rear end;
  - a front end;
  - a diameter;
  - a mounting rod being axially formed on and protruding from the front end of the transmitting shaft and extending out of the retaining ring of the casing and having
    - a diameter being smaller than that of the transmitting shaft; and
    - a front end; and
  - a threaded pipe being formed on and protruding from the front end of the mounting rod and having
    - a diameter being smaller than that of the mounting rod;
    - a rear end; and
    - a holding hole being axially formed in the threaded pipe;
- a clutch shaft being rotatably mounted on the external surface of the casing to control the transmitting shaft connecting to or separating from the drive shaft;
- a spring being mounted around the threaded pipe of the drive shaft and having a front end;
- a cover being mounted in the protective caps, being mounted around the mounting rod and the threaded pipe of the transmitting shaft and having
  - a front end;
  - a rear end;
  - a pointed nose being formed on and protruding from the front end of the cover and having a free end; and
  - a flange being formed annularly on and protruding from the rear end of the cover and having a clearance relative to the front end of the rear protective cap; and
- a clamping tube being mounted securely in the holding hole of the threaded pipe and having
  - an external surface;
  - an inner end being mounted securely in the holding hole of the threaded pipe of the transmitting shaft;
  - an outer end extending out of the conical hole of the cover; and
  - a collet being formed on the outer end of the clamping tube and being pressed against the cover in the conical hole and having
    - an external surface; and
    - multiple slits being individually formed through the external surface of the collet at intervals.

3. The safe guarding assembly as claimed in claim 2, wherein the cover further has a mounting segment being formed through the cover and the pointed nose and having a conical hole being formed through the free end of the pointed nose and aligning with the threaded pipe of the transmitting shaft;

a mounting hole being formed through the rear end of the cover to cover the spring on the threaded pipe; and a mounting recess being defined in the pointed nose and communicating with the conical hole and the mounting hole; and the front end of the spring is pressed against the cover near the mounting recess.

4. The safe guarding assembly as claimed in claim 3, wherein the safe guarding assembly further has a supporting tube being mounted securely in the clamping tube and having a front end pressed against the collet of the clamping tube to cause the collet to press against the conical hole of the cover and maintain clearance between the rear protective cap and the flange plate of the cover.

5. The safe guarding assembly as claimed in claim 4, wherein the threaded pipe further has an inner thread formed in the holding hole near the rear end of the threaded pipe; and the clamping tube further has an outer thread formed around the external surface of the clamping tube near the inner end and being screwed with the inner thread of the threaded pipe.

6. The safe guarding assembly as claimed in claim 2, wherein the safe guarding assembly further has a supporting tube being mounted securely in the clamping tube and having a front end pressed against the collet of the clamping tube to cause the collet to press against the conical hole of the cover and maintain clearance between the rear protective cap and the flange plate of the cover.

7. The safe guarding assembly as claimed in claim 6, wherein the threaded pipe further has an inner thread formed in the holding hole near the rear end of the threaded pipe; and the clamping tube further has an outer thread formed around the external surface of the clamping tube near the inner end and being screwed with the inner thread of the threaded pipe.

8. The safe guarding assembly as claimed in claim 2, wherein the threaded pipe further has an inner thread formed in the holding hole near the rear end of the threaded pipe; and the clamping tube further has an outer thread formed around the external surface of the clamping tube near the inner end and being screwed with the inner thread of the threaded pipe.

* * * * *